US011913459B2

(12) United States Patent
Foo

(10) Patent No.: US 11,913,459 B2
(45) Date of Patent: Feb. 27, 2024

(54) FAN ASSEMBLY WITH A MAGNETIC VANE ROTOR

(71) Applicant: Chi Cheung Foo, Chai Wan (HK)

(72) Inventor: Chi Cheung Foo, Chai Wan (HK)

( * ) Notice: Subject to any disclaimer, the term of this patent is extended or adjusted under 35 U.S.C. 154(b) by 0 days.

(21) Appl. No.: 17/692,995

(22) Filed: Mar. 11, 2022

(65) Prior Publication Data

US 2023/0287891 A1 Sep. 14, 2023

(51) Int. Cl.
*F04D 25/02* (2006.01)
*F04D 19/00* (2006.01)

(52) U.S. Cl.
CPC ..... *F04D 25/026* (2013.01); *F04D 19/002* (2013.01)

(58) Field of Classification Search
CPC ..... F04B 25/026; F04B 19/002; F04B 29/002
See application file for complete search history.

(56) References Cited

U.S. PATENT DOCUMENTS 4,459,087 A * 7/1984 Barge ..... H02K 1/246 416/189
10,107,294 B2 * 10/2018 Jang ..... F04D 29/522
2021/0156387 A1 * 5/2021 Chiu ..... F04D 25/06

FOREIGN PATENT DOCUMENTS

CN 107956721 A * 4/2018 ..... F04D 19/002
CN 112421806 A * 2/2021
DE 4230420 A1 * 4/1993 ..... F04D 25/0606
NL 9401288 A * 3/1996 ..... F04D 25/066

OTHER PUBLICATIONS

English Abstract of DE-4230420-A1 (Year: 1993).*
English Abstract of NL-9401288-A (Year: 1996).*
English Machine Translation of CN-107956721-A (Year: 2018).*

* cited by examiner

*Primary Examiner* — Nathan C Zollinger
(74) *Attorney, Agent, or Firm* — Muncy, Geissler, Olds & Lowe, P.C.

(57) ABSTRACT

A fan assembly includes a fan cover. The fan cover is provided with a vane assembly and is fixed by a rotating shaft, which includes blades and magnetic vanes arranged along its outer contour. The coils are evenly arranged along the fan cover. The magnetic rotor blade and the alternating magnetic field generated by the coils can drive the blades to rotate, and the rotation speed can be adjusted by changing the speed of the alternating magnetic field. The coils are fixedly installed in the outer cover of the fan, and the vane assembly is only installed by the rotating shaft, which can easily disassemble from the vane assembly. The structure is simple and has higher reliability. So, it is not easily damaged, and has a longer service life. The fan assembly can be completely waterproof, so that the product can be used in high humidity and even water.

4 Claims, 5 Drawing Sheets

FAN ASSEMBLY WITH A MAGNETIC VANE ROTOR

FIELD OF THE INVENTION

The invention relates to a fan which drives the blades to rotate by the magnetic vanes.

BACKGROUND OF THE INVENTION

Fan is the most commonly used household appliance in summer. Existing fan generally needs to be driven by a motor, and the motor generally consists of a stator and a rotor, and the rotor is connected to the blades of the fan by an output shaft. The mechanical structure of an ordinary fan is relatively complex. If the parts need to be disassembled for cleaning, maintenance, etc., the protective cover needs to be disassembled first, and then the blades. For parts, such as motors, user is generally not allowed to disassemble it. On the one hand, considering the difficulty of disassembly and assembly, on the other hand, because the control of the motor involves the circuit part, the improper operation may cause risks such as electric shock.

SUMMARY OF THE INVENTION

In view of the aforesaid drawbacks of the prior art, the present invention provides a fan assembly with a magnetic vane rotor to eliminate the use of a motor as a driving structure, and directly use magnetic blades or set magnetic rotors on the blades which cooperate with the magnetic field generated by the coils to drive the magnetic blades or rotors to rotate, thereby simplifying the whole the design of the fan assembly for conveniently being disassembled the rotating parts by user.

So, the present invention provides:

A fan assembly with a magnetic vane rotor, wherein comprising a fan cover, a vane assembly is arranged in the fan cover, and the vane assembly includes blades, which are installed on a rotating shaft to fixed with the fan cover; the vane assembly is uniformly provided with magnetic vanes along the outer contour, and the fan cover is evenly equipped with magnetic coils which generates an alternating magnetic field to drive the magnetic vanes and the vane assembly to rotate.

Further, the magnetic vanes form a certain inclination angle with the axial direction of the rotating shaft and extends to form the blades, and the magnetic vane is arranged at the end of each the blade.

Further, the blades are evenly distributed along the radial direction of the rotating shaft, the outer periphery of the blades is connected with a ring, and the outer periphery of the ring is evenly provided with the magnetic vanes.

Further, the fan cover at least comprises an annular cover and an air guide cover arranged at its opening; the two ends of the rotating shaft are pivotally connected to the air guide cover, the coils are embedded in the annular housing.

Further, the magnetic vane forms a certain inclination angle with the axial direction of the rotating shaft, and the inclination angle is the same as or opposite to the inclination angle of the blade.

Further, the number of the vane assemblies is more than two groups, which are sequentially installed on the rotating shaft, and each group of vane assemblies independently rotates around the rotating shaft.

The invention has the following advantages: the cooperation of the magnetic vanes and the alternating magnetic field generated by the coils can drive the blades to rotate, and the rotation speed is adjusted by the changing speed of the alternating magnetic field. The coils are fixedly installed in the outer cover of the fan, so that don't need to be disassembled in daily cleaning and maintenance. And the vane assembly is only installed by the rotating shaft, so the entire vane assembly can be easily disassembled. In addition, the whole structure is simpler than that of the existing fan with a motor, and has higher reliability in use, is not easy to be damaged to has a longer service life. And the electrified coils and control circuit part can be completely enclosed in the housing, so the fan assembly can be completely waterproof, and the product can be used in high humidity and even water. Moreover, the structure of the present invention can also be applied to various other products, such as hair dryers, dehumidifiers, air conditioners, heaters and the like.

BRIEF DESCRIPTION OF THE DRAWINGS

Below are explanations of the invention combining with drawings.

In the figures: 1. the fan cover, 2. the vane assembly, 3. the blade(s), 4. the rotating shaft, 5. the magnetic vane(s), 6. the magnetic coil(s), 7. the ring, 8. the annular housing, 9. the air guide cover.

DESCRIPTION OF THE EMBODIMENTS

Figure 1:
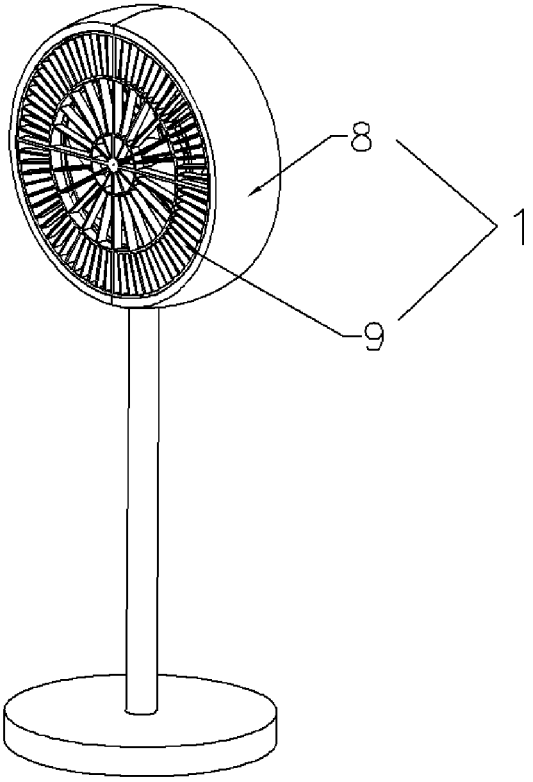
FIG. 1 is the perspective view of the embodiment 1 in present invention.
Figure 2:
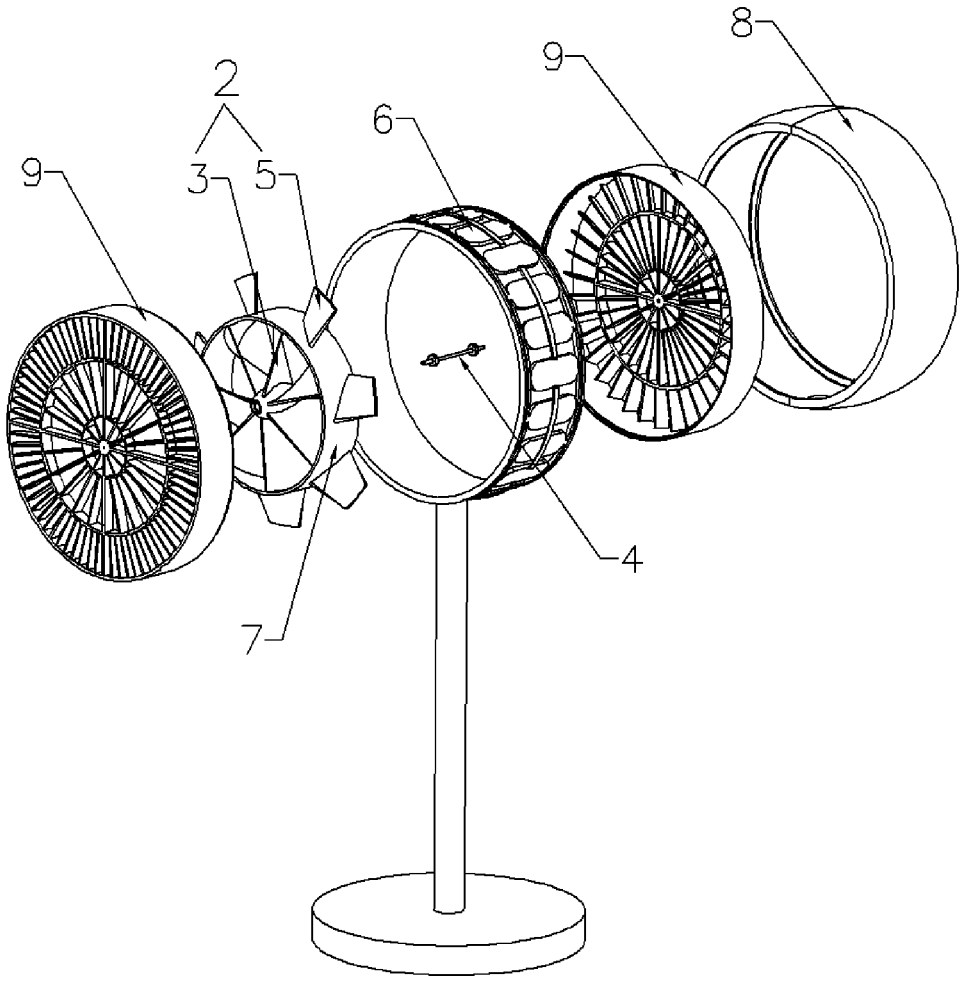
FIG. 2 is an exploded view of FIG. 1.

Refer to FIG. 1 and FIG. 2, the fan assembly with a magnetic vane rotor includes the fan cover 1, and the vane assembly 2 is arranged in the fan cover 1, which is fixed to the fan cover 1 through the rotating shaft 4. The vane assembly 2 includes blades 3 of the fan and the magnetic vanes 5, wherein blades 3 are evenly distributed along the radial direction of the rotating shaft 4 and form a certain inclination angle with the axial direction of the rotating shaft 4. The magnetic vanes 5 are evenly arranged at certain intervals along the outer contour of the blades, and correspondingly, the coils 6 are evenly arranged in the fan cover 1. The coils 6 are connected to the control circuit, and the control circuit sends the control signal to each coil 6 according to the position and speed of each magnetic vane 5 to generate the magnetic field and change the direction of the magnetic field, etc., thereby driving the magnetic vanes 5 to drive the blades 3 to rotate, and the rotation speed can be adjusted by changing speed of the alternating magnetic field. The coil 6 is fixedly installed in the outer cover of the fan, and does not need to be disassembled in daily cleaning and maintenance, and the vane assembly 2 is only installed on the rotating shaft 4, so the vane assembly 2 can be easily disassembled. In addition, the whole structure is simpler than that of the existing fan with a motor, and has higher reliability in use. So, it is not easy to be damaged, and has a longer service life. Moreover, the electrified coils 6 and the control circuit part can be completely enclosed in the housing, so the fan assembly can be completely waterproof, so that the product can be used in high humidity or even water. Further, the structure of the present invention can also be applied to various other products, such as hair dryers, dehumidifiers, air conditioners, heaters and the like.

Figure 3:
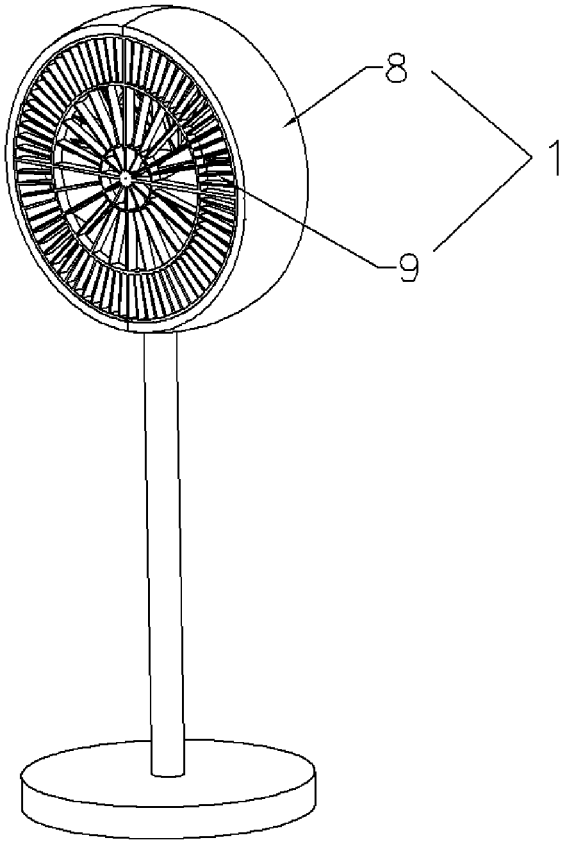
FIG. 3 is the perspective view of the embodiment 2 in present invention.
Figure 4:
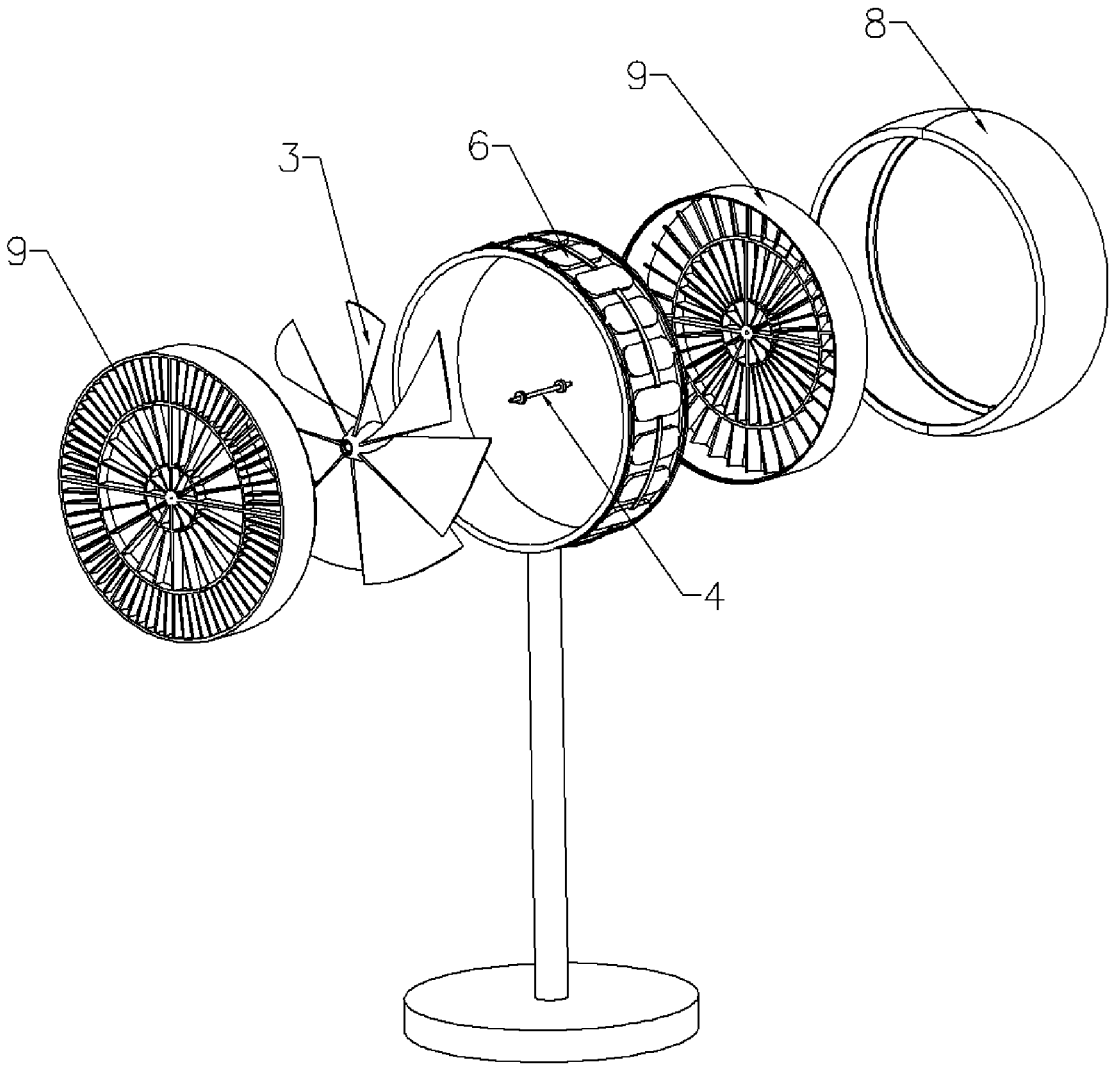
FIG. 4 is an exploded view of FIG. 3.

The magnetic vans 5 can be directly extended to form the blades 3, whereby the magnetic vanes 5 and the axial direction of the rotating shaft 4 form a certain inclination angle and extend to form the blades 3 of the fan. So that, the magnetic vanes 5 and the blades 3 are an integrated design, as shown in FIG. 3 and FIG. 4.

Another design is to separate the magnetic vanes 5 from the blades 3, that is, the blades 3 are evenly distributed along the radial direction of the rotating shaft 4, the outer circumference of the blades 3 is connected with a ring 7, and the outer circumference of the fixed ring 7 is evenly distributed the magnetic vanes 5. The blades 3 and the magnetic vanes 5 are connected to the ring 7. The design considers that the matching of different numbers of magnetic rotor blades 5 and fan blades 3 can generate different wind pressure and speed in the same rotational speed. At the same time, the inclination angle of the magnetic vanes 5 and the inclination angle of the blades 3 can also be set to be opposite, so as to generate opposite different airflows to meet some special needs and so on.

In order to facilitate the installation of the rotating shaft 4 to simplify the disassembly of the entire fan assembly, the fan cover 1 at least includes an annular housing 8 and the air guide cover 9 which is disposed at the opening of the annular housing 8. The coils 6 are embedded in the annular housing 8, and then the two ends of the rotating shaft 4 are pivotally connected to the wind guide cover 9 respectively. When being disassembled, the vane assembly 2 can be completely taken out while dissembling the air guide cover 9 from the annular housing 8, that is very convenient.

The number of the vane assembly 2 is two or more, which are independently installed on the rotating shaft 4. Each group of rotating vane assemblies 2 rotates independently around the rotating shaft 4.

Figure 5:
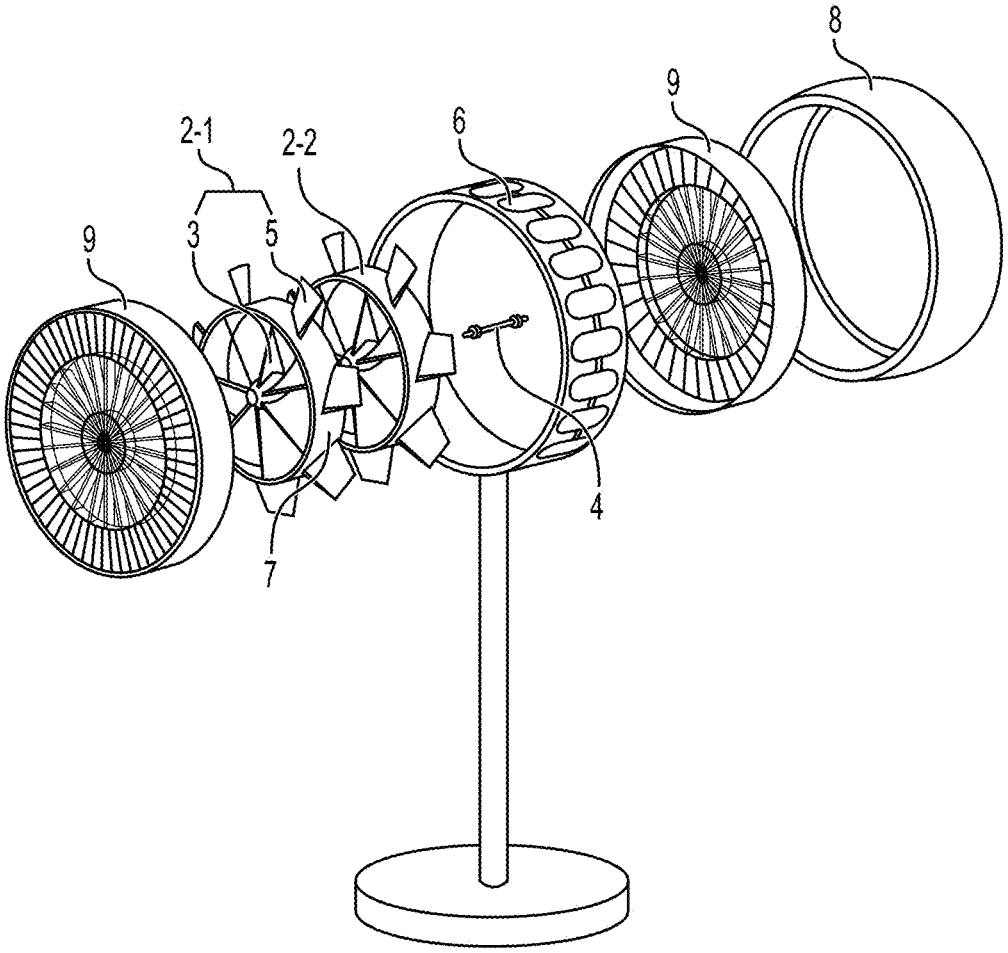
FIG. 5 is the perspective view of another embodiment in present invention.

In addition, one or more sets of the vane assemblies 2 can also be installed on the rotating shaft 4. For example, as shown in FIG. 5, there may be two vane assemblies 2-1 and 2-2 that are installed on the rotating shaft 4. By configuring the corresponding number of the magnetic vanes 5 and the blades 3 of each vane assembly 2, each vane assemblies 2 can be rotated in different rotational speed, thus forming different wind speeds, wind pressures, wind angles and so on. Moreover, the user can also conveniently replace and configure the vane assemblies 2 with different functions to meet the needs of use.

The invention claimed is:

1. A fan assembly with a magnetic vane rotor, comprising:

a fan cover having a rotating shaft provided therein; and a vane assembly arranged in the fan cover and configured to rotate on the rotating shaft, the vane assembly including a fixed ring, blades evenly distributed along an inner periphery of the fixed ring, and magnetic vanes evenly distributed along an outer periphery of the fixed ring, wherein the fan cover is evenly equipped with magnetic coils which generates an alternating magnetic field to drive the magnetic vanes and the blades to rotate, and the magnetic vanes and the blades form a certain inclination angle with an axial direction of the rotating shaft, the inclination angle of the blades being one of an acute angle or an obtuse angle relative to the axial direction of the rotating shaft and the inclination angle of the magnetic vanes being the other one of the acute angle and the obtuse angle relative to the axial direction of the rotating shaft, thereby the magnetic vanes and the blades are configured to generate opposite airflows when the vane assembly is rotated.

2. The fan assembly with the magnetic vane rotor of claim 1, wherein the magnetic vanes is arranged at the end of each of the blades.

3. The fan assembly with the magnetic vane rotor of claim 1, wherein the fan cover at least comprises an annular cover and two air guide covers arranged at both sides of an opening of the annular cover; the two ends of the rotating shaft are pivotally connected to the air guide covers and the magnetic coils are embedded in the annular housing.

4. The fan assembly with the magnetic vane rotor of claim 1, wherein the vane assembly is a plurality of vane assemblies comprising more than two groups, which are sequentially installed on the rotating shaft, and each group of vane assemblies independently rotates around the rotating shaft.

* * * * *